United States Patent [19]

Brammer

[11] Patent Number: 4,463,715

[45] Date of Patent: Aug. 7, 1984

[54] OTTO ENGINE IGNITION PULSE GENERATOR AND DISTRIBUTOR

[75] Inventor: Hartmut Brammer, Vaihingen, Fed. Rep. of Germany

[73] Assignee: Robert Bosch GmbH, Stuttgart, Fed. Rep. of Germany

[21] Appl. No.: 398,651

[22] Filed: Jul. 15, 1982

[30] Foreign Application Priority Data

Aug. 11, 1981 [DE] Fed. Rep. of Germany ..... 3131644

[51] Int. Cl.[3] ..... F02P 1/00

[52] U.S. Cl. ..... 123/146.5 A; 310/70 A; 310/70 R; 123/617; 200/19 M

[58] Field of Search ..... 123/146.5 A, 617; 200/19 M, 27 A, 27 R; 310/70 A, 70 R

[56] References Cited

U.S. PATENT DOCUMENTS

| | | | |
|---|---|---|---|
| 3,258,550 | 6/1966 | Guetersloh et al. | 310/70 R |
| 3,447,004 | 5/1969 | Falge | 310/70 R |
| 3,600,530 | 8/1971 | Dusenberry et al. | 310/70 A |
| 3,744,466 | 7/1973 | Brammer et al. . | |
| 4,307,698 | 12/1981 | Yoshinari | 123/146.5 A |

FOREIGN PATENT DOCUMENTS

| | | | |
|---|---|---|---|
| 2298011 | 10/1974 | France | 123/146.5 A |

OTHER PUBLICATIONS

"GT" Distributor with Magnetic Timer. Marchal. Oct. 1974 *Technical Document.*

*Primary Examiner*—Parshotam S. Lall

*Attorney, Agent, or Firm*—Frishauf, Holtz, Goodman & Woodward

[57] ABSTRACT

To eliminate frictional effects by stationary elements (17, 37, 47) with respect to a sleeve (16, 36, 46) which rotates with a shaft (11) of a distributor, but is adjustable with respect to the instantaneous position about the shaft by a centrifugal spark advance mechanism (15), the nonrotatable elements (17, 37, 47) are secured from a support plate (22, 32, 49) which is positioned intermediate the sleeve and the distributor rotor, the support plate being journalled by bearings (23, 33, 44, 45) directly on the shaft. A load-dependent vacuum chamber can be linked directly to the support plate for additional load-dependent spark timing adjustment.

8 Claims, 3 Drawing Figures

OTTO ENGINE IGNITION PULSE GENERATOR AND DISTRIBUTOR

The present invention relates to an ignition distributor for externally ignited internal combustion (IC) engines, and more particularly to an improvement on the distributor-pulse generator combination described in the earlier U.S. Pat. No. 3,744,466, Brammer et al, assigned to the assignee of the present invention.

BACKGROUND

An ignition distributor in which a pulse generator unit, which may be a breaker contact, or a stationary element of a contact-less pulse generator is movably located within a housing, adjustable by a centrifugal force unit, is described in the aforementioned U.S. Pat. No. 3,744,466. In accordance with this disclosure, the shaft of the distributor is driven from the internal combustion (IC) engine, in well-known manner, and drives a rotor. The stationary element of the rotor is journalled on a carrier sleeve which is coupled to the distributor rotor.

It has been found that by journaling the stationary portions on the carrier sleeve, the frictional forces in the bearing will change with speed of the rotor, and affect the ignition timing in accordance with rotor speed, as controlled by the centrifugal timing element.

THE INVENTION

It is an object to improve a distributor of the general type described in the aforementioned U.S. Pat. No. 3,744,466 by overcoming undesired frictional effects.

Briefly, the distributor rotor is coupled to an end portion of the distributor shaft for rotation therewith. A spark pulse generation system, which may be a contact-less system including, for example, a Hall generator, or breaker contacts, includes a rotatable element secured through a carrier sleeve which can rotate with the shaft, but additionally rotates with respect thereto, that is, changes instantaneous angular position to accomodate ignition advance-retardation movements controlled by a centrifugal controller. A nonrotatable element is provided, such as a stator for a contact-less ignition generator, or the stationary element of breaker contacts, secured to support means which support the nonrotatable elements. The support means are journalled directly on the shaft, to permit rotation of the shaft with respect thereto. The stationary positioning means may be shifted in angular position with respect to the housing, or a reference position by a vacuum diaphragm, to change the ignition timing as a function of loading on the engine. For simplicity of construction, the support means for the stationary element are located between the rotatable element, secured to the sleeve and the end portion of the shaft which, in turn, supports the distributor rotor.

The system is applicable both to a contact-less arrangement, which may operate in the form of an inductive generator, or with a Hall generator; or to a contacting-type breaker system, in which the rotatable element is a breaker cam.

The system has the advantage that predetermined ignition timing characteristics based on speed can be accurately maintained, and frictional forces affecting the positioning of the stator are accepted by the distributor shaft and cannot reduce the speed of the distributor shaft, since the distributor shaft is positively coupled to be driven by the internal combustion (IC) engine; in usual operation, the distributor shaft is driven from the cam shaft of the engine. Frictional effects acting on the support sleeve, which can shift under control of the centrifugal speed advance mechanism due to friction with the stationary elements, are avoided.

If the distributor-pulse generator unit uses breaker contacts, then, in accordance with the preferred embodiment, the sleeve is formed at its upper portion with an enlarged region, leaving a gap between the sleeve and the distributor shaft, and the bearing supporting the stationary part of the breaker terminals is telescopically fitted on the shaft within the upper enlarged portion of the sleeve. Torque effects, and stray forces are thereby effectively avoided, particularly if, in accordance with the preferred embodiment, the stationary portions are supported by a carrier disk extending laterally from the bearing about the main distributor shaft. The terminal portion of the sleeve can then be formed as the cam which operates the breaker terminals. Since the support disk is journalled about the distributor shaft, it can also be rocked for further adjustment of ignition timing, for example by being coupled to a link connected to a pressure diaphragm coupled to the intake manifold of the IC engine.

DRAWINGS

Figure 1:
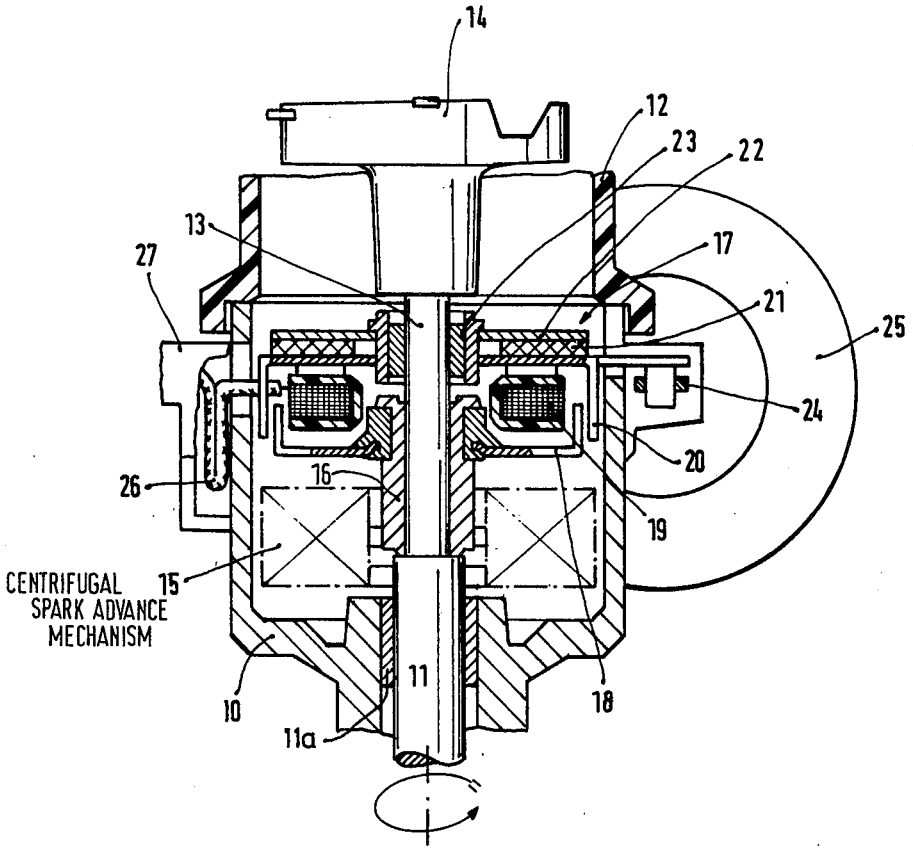
FIG. 1 is a schematic axial fragmentary view through an ignition distributor, omitting all components and parts not necessary for an understanding of the invention, and showing an inductive-type contact-less ignition pulse generator.

A housing 10 for the distributor-breaker combination (FIG. 1) is closed off by a distributor cap 12, shown only in part. A distributor shaft 11 is coupled to the IC engine, to rotate therewith. The upper portion 13 of the distributor shaft 11 is connected to the distributor rotor 14, which, for example, is securely fastened thereon, to rotate with the shaft 11. The distributor rotor distributes the high voltage from the spark coil to the spark plugs. A centrifugal advance mechanism 15 is coupled to the shaft 11, to rotate therewith and further coupled to a sleeve 16, to rotate the sleeve 16 together with the shaft 11, while additionally shifting the position of the rotating sleeve 16 with respect to the shaft 11 in accordance with the speed of the engine, as transmitted to the distributor by the shaft 11.

For a complete illustration of the system, reference is made to the above-referred to U.S. Pat. No. 3,744,466.

The invention will first be described in connection with an inductive contact-less ignition pulse generator. The inductive pulse generator, essentially includes a rotor 18 secured to the sleeve 16 which, as noted, rotates with the shaft 11, but is capable of shifting its instantaneous angular position with respect to the shaft 11 under the control of the centrifugal generator 15. The inductive generator further includes a stator 17 which has a pole shoe, or pole disk 20, a coil 19, and a permanent magnet 21. The coil 19, the pole disk 20 and the permanent magnet 21 are all secured to a carrier plate 22.

In accordance with the present invention, the carrier plate 22 is journalled directly on the shaft 11. The carrier plate 22 is secured to a bearing bushing or sleeve 23, rotatable with respect to the shaft 11. The bearing 23 is positioned between the sleeve 16 and below the rotor 14, so that both stator 17 as well as rotor 18 are positioned beneath the rotor 14, the stator 17 being placed between the rotatable element 18 of the inductive generator and the distributor 14.

The stator 17 is not completely stationary, but rather is an essentially stationary element. A connecting rod 24 is hooked to a lateral extension from the stationary element 17, and connected to a diaphragm chamber 25 which, in turn, is connected to the intake manifold, for example, of the IC engine, in order to provide for change of the ignition timing by rotating the stationary element 17 by a few degrees backwards and forwards, in accordance with load being placed on the IC engine. Coil 19 of the stationary element 17 is connected by electric coupling lines 26 to a plug-connector 27 to provide for electrical connection of the coil to external ignition control units (not shown).

Figure 2:
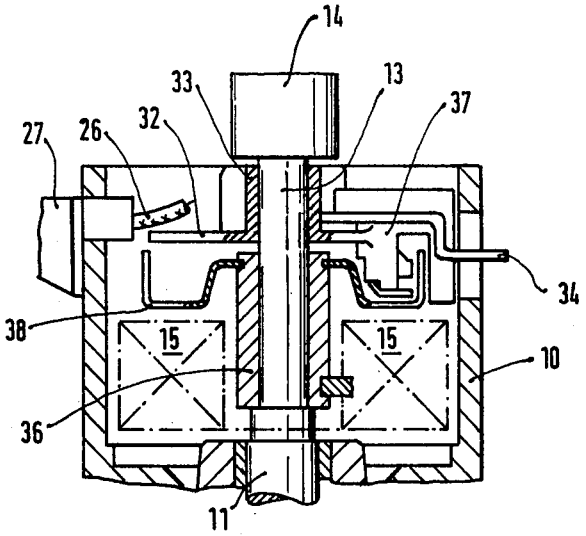
FIG. 2 is a schematic fragmentary view similar to FIG. 1 and illustrating a Hall-type transducer providing contact-less ignition control pulses.

Embodiment of FIG. 2: elements already described have been given the same reference numeral and will not be described again. In contrast to the inductive generator of FIG. 1, FIG. 2 has a contact-less ignition pulse control element which uses a Hall generator. The Hall generator has a rotor 38 which is coupled to the sleeve 36 which corresponds to sleeve 16 of FIG. 1. The stationary element 37 has a support plate 32 which is integral with a bearing bushing or bearing sleeve 33, journalled to rotate about shaft 11. The support plate 32 is connected to the connecting rod 34 which is coupled to the vacuum diaphragm chamber 25 (not shown in FIG. 2). The bearing sleeve 33 thus can rock, in accordance with the control from rod 34 with respect to the housing, while the shaft 11 rotates in accordance with the rotation transmitted thereto by the IC engine. The unitary assembly made of Hall generator housing 37, carrier plate 32 and bearing bushing 33 is located between the rotor 38 of the Hall generator and the distributor rotor 14, which is shown rotated 90° with respect to the position illustrated in FIG. 1.

Figure 3:
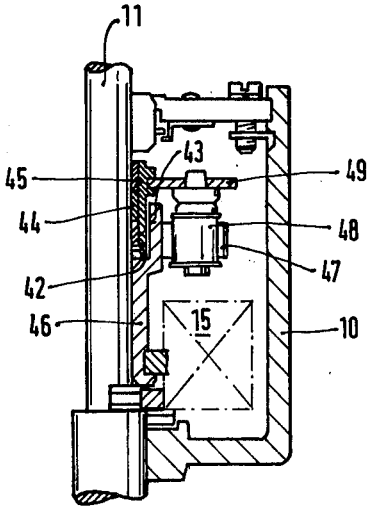
FIG. 3 is a fragmentary half sectional view illustrating a mechanical breaker switch arrangement.

Embodiment of FIG. 3—breaker-type distributor: a lever contact 47, which may be in accordance with any well-known construction, cooperates with a fixed contact 48. This mechanical arrangement is secured to the underside of a carrier plate 49. Carrier plate 49, in turn, is attached to a bearing bushing 45 which has a plurality of bearing rings 44 therein, so that the bearing bushing 45, and with it the plate 49 are journalled on the shaft 11.

A cam 43 is formed on the sleeve 46, which is coupled to the centrifugal ignition advance positioning element 15. Sleeve 46 corresponds to sleeve 16 of FIG. 1. The cam 43 operates the lever contact 47. Sleeve 46, at the axial level of the cam 43, is expanded to permit, at least in part, telescopic positioning of the bearing bushing 45 and bearing rings 44 thereon within the upper end portion of the sleeve 46—see FIG. 3.—i.e. within space 42 between sleeve 46 and shaft 11.

The disk 49, secured to the bearing bushing 45 is coupled to a control rod 24, or 34, for positioning in dependence on load, by a diaphragm vacuum chamber, as shown in greater in FIGS. 1 and 2. Load-dependent positioning of a mechanical contact, and the hooking arrangement are well-known and can be in accordance with any suitable construction. The distributor rotor, not shown in FIG. 3, is secured to the shaft 11 above the carrier plate 49. A further upper bearing, and support bracket may be used in the construction with a mechanical breaker to prevent dust and dirt from contaminating the mechanical breaker assembly and to improve the centricity of the upper portion of the shaft 11 in operation.

Various changes and modifications may be made and the features described in connection with any one of the embodiments may be used with any of the others, within the scope of the inventive concept.

I claim:

1. Otto engine ignition pulse generator and distributor combination having a housing (10, 12);

a distributor shaft (11) journalled in the housing and connectable to the engine;

a spark advance sleeve (16, 36, 46) surrounding the shaft (11) rotating therewith and being rotatable with respect thereto, said sleeve being located at a portion of the shaft close to the engine;

a centrifugal spark advance mechanism (15) coupled to the shaft and to the sleeve, rotating with the shaft and adjusting the relative angular position between the shaft and the sleeve in dependence on speed of the shaft, and positioned around the shaft at the portion thereof close to the engine;

a distributor rotor (14) coupled to and driven by an end portion (13) of the shaft, remote from the engine;

spark pulse generating means located within the housing, upwardly from said portion close to the engine, to locate the spark pulse generating means between the distributor rotor and the centrifugal spark advance mechanism;

a bearing (11*a*) journalling the shaft (11) in the housing at a portion close to the engine;

a vacuum diaphragm chamber (25) secured to the housing;

and wherein the spark pulse generating means comprises a rotatable element (18, 38, 43) secured to the sleeve (16, 36, 46) to rotate therewith;

a non-rotatable element (17, 37, 47, 48);

support means (22, 32, 45, 49) for supporting said non-rotatable element, said support means being journalled on the shaft (11);

means (24), connected to the vacuum diaphragm chamber (25) and to said support means, for coupling the output of said vacuum diaphragm chamber to the support means and hence to the non-rotatable element, and to shift the non-rotatable element within the housing about the shaft (11), and a bearing (23, 33, 45) between said support means and the shaft and journalling said support means on the shaft, positioned adjacent the end portion (13) of the shaft remote from the engine.

2. Combination according to claim 1 wherein the spark pulse generating means comprises a contact-less pulse generator.

3. Combination according to claim 2 wherein the contact-less pulse generator comprises an inductive generator;

said inductive generators including a stator unit (17, 19, 20, 21) and a rotor unit (18);

and wherein said support means comprises a support disk (22) and a bearing (23) surrounding the shaft, the support disk being secured to the bearing (23), and the rotor unit (18) being secured to said sleeve (16) said bearing (23) being positioned between the sleeve (16) and the distributor rotor (14), and the stator unit being located on said bearing disk (22) at the side facing the rotor unit.

4. Combination according to claim 3 wherein the stator unit comprises an induction coil element, a pole disk element, and a permanent magnet element, and all said elements are located at the side of said support disk (22) facing the rotor unit.

5. Combination according to claim 2 wherein the contact-less pulse generator comprises a Hall generator, and wherein the support means comprises a support disk (32) and a bearing (33) journalling the support disk (32) on the shaft (11), and positioned between said sleeve (36) and the distributor rotor (14);

a flux guide rotor (38) secured to said sleeve;

and wherein the Hall generator is positioned on said support plate (32) at the side thereof facing said flux guide rotor unit.

6. Combination according to claim 5 wherein a housing (37) for the Hall generator is provided;

and the carrier plate (32), the housing for the Hall generator, and the bearing (33) are a unitary element journalled on said shaft (11).

7. Combination according to claim 1 wherein the spark pulse generating means comprises breaker contacts (47, 48);

the support means comprises a carrier plate (49) and a bearing (45) to which said carrier plate is secured, in journaling the carrier plate on the shaft (11), the breaker contacts (47, 48) being secured and supported on said carrier plate at the side thereof facing the sleeve (46);

and a cam (43) operating the breaker contacts and secured to said sleeve.

8. Combination according to claim 7 wherein said sleeve (46) is formed with an axial enlargement in the region of said breaker contacts to leave a space (42) between the sleeve (46) and said shaft (11);

and wherein said bearing (45) includes bearing rings (44) located, at least in part, within said space and telescopically received within the axially enlarged portion of said sleeve.

* * * * *